US008826616B1

(12) United States Patent
Gosselin

(10) Patent No.: US 8,826,616 B1
(45) Date of Patent: Sep. 9, 2014

(54) METAL PROFILE WITH THERMAL BREAK

(71) Applicant: Les Portes J.P.R. Inc., Laval (CA)

(72) Inventor: Pierre Gosselin, Laval (CA)

(73) Assignee: Les Portes J.P.R. Inc., Laval, Quebec ( * ) Notice: Subject to any disclaimer, the term of this patent is extended or adjusted under 35 U.S.C. 154(b) by 0 days.

(21) Appl. No.: 13/874,588

(22) Filed: May 1, 2013

(51) Int. Cl.

| | |
|---|---|
| ***E04C 1/00*** | (2006.01) |
| ***E06B 3/30*** | (2006.01) |
| ***E06B 3/16*** | (2006.01) |
| ***E06B 3/96*** | (2006.01) |

(52) U.S. Cl.
CPC ..... *E06B 3/163* (2013.01); *E06B 3/9616* (2013.01)
USPC ..... 52/309.3; 52/309.1; 52/204.5; 52/204.53

(58) Field of Classification Search
CPC ..... E06B 3/221; E06B 3/30; E06B 3/08; E06B 3/06
USPC ..... 52/309.3, 309.1, 204.5, 204.53
See application file for complete search history.

(56) References Cited

U.S. PATENT DOCUMENTS

| | | | | |
|---|---|---|---|---|
| 6,125,608 | A | 10/2000 | Charlson | |
| 6,158,190 | A | 12/2000 | Seng | |
| 6,279,287 | B1 * | 8/2001 | Meadows | 52/589.1 |
| 6,314,701 | B1 * | 11/2001 | Meyerson | 52/588.1 |
| 6,962,025 | B1 * | 11/2005 | Hill | 52/396.04 |
| 2007/0151169 | A1 * | 7/2007 | Kandasamy | 52/79.1 |
| 2010/0236172 | A1 | 9/2010 | Wirth | |
| 2012/0011793 | A1 | 1/2012 | Clark | |

* cited by examiner

*Primary Examiner* — Mark Wendell
(74) *Attorney, Agent, or Firm* — BCF LLP

(57) ABSTRACT

The present relates to a metal profile having a thermal break for making doors. The metal profile comprises two complementary metal structural members. The two complementary metal structural members define at least one junction area there between, where each junction area defines a channel between the two complementary metal structural members. The metal profile further comprises a structural adhesive material for filling each of the channel. The structural adhesive material simultaneously forms a mechanical joint and a thermal break between the two complementary metal structural members. The structural adhesive material has a low thermal conductivity, a high percentage of elongation, and maintains a high rigidity of the metal profile. In an embodiment, the two structural members are made of aluminum.

20 Claims, 10 Drawing Sheets

METAL PROFILE WITH THERMAL BREAK

TECHNICAL HELD

The present disclosure relates to the field of doors and windows made of an assembly of metal profiles. More specifically, the present disclosure relates to metal profiles with a thermal break for making doors.

BACKGROUND

Doors may be made of various materials, depending on their usage (e.g. residential, commercial or industrial) and characteristics (e.g. size, weight, rigidity). A particular category of doors is made of metal, specifically of an assembly of metal profiles. For instance, aluminum may be used, since it is lighter than other metals like steel, and demonstrates different architectural properties. The metal profiles may have various shapes, to accommodate doors with various shapes and characteristics, and to allow the integration of other components in the door (e.g. windows). An important drawback of the usage of metal for making doors is that it has a high thermal conductivity. Thus, if a metallic door separates two environments with a significant difference of temperature, the door acts as a thermal conductor from the environment with the highest temperature to the environment with the lowest temperature.

One method to prevent a metal profile from acting as a thermal conductor consists in injecting a material having insulating properties in an inner structure of the metal profile, to act as a thermal break. Polyurethane is generally mentioned as a material having the required insulating properties, as well as sufficient adhesive properties to adhere to the inner structure of the metal profile. However, the introduction of the insulating material is not sufficient by itself to reduce the heat transfer as the thermal conductivity of the metallic envelope remains intact. Therefore creating an efficient thermal break in the inner structure of the metal profile generally implies to divide an originally single metallic structural member of the metal profile, into at least two resulting structural members after having injected the insulating material in the profile. The insulating material (such as polyurethane) having only limited adhesive properties and limited structural strength, the overall rigidity and resistance to deformation of the metal profile may be weakened. This limits the usage of such an insulating material to certain types of metal profiles and applications, where constraints related to rigidity and resistance to deformation are not an important issue.

Therefore, there is a need for a new metal profile with thermal break for making doors, which overcomes the aforementioned limitations.

SUMMARY

According to a first aspect, the present disclosure provides a metal profile. The metal profile comprises two complementary metal structural members defining at least one junction area there between. Each junction area defines a channel between the two complementary metal structural members. A structural adhesive material fills each of the channel. The structural adhesive material simultaneously forms a mechanical joint and a thermal break between the two complementary metal structural members.

According to an aspect of the present disclosure, the two complementary structural members are made of aluminum.

According to one or several aspects of the present disclosure, the structural adhesive material has a thermal conductivity 450 to 550 times lower than the thermal conductivity of aluminum.

According to one or several aspects of the present disclosure, a rigidity of the metal profile with the two complementary aluminum structural members and the structural adhesive material is similar to a rigidity of an equivalent profile consisting of a single aluminum structural member.

According to one or several aspects of the present disclosure, the structural adhesive material has a percentage of elongation of at least 200%.

According to one or several aspects of the present disclosure, the structural adhesive material consists of a modified silane polymer.

According to one or several aspects, the present disclosure provides a door comprising an assembly of the aforementioned metal profiles.

BRIEF DESCRIPTION OF THE DRAWINGS

Embodiments of the disclosure will be described by way of example only with reference to the accompanying drawings, in which.

DETAILED DESCRIPTION

Figure 1:
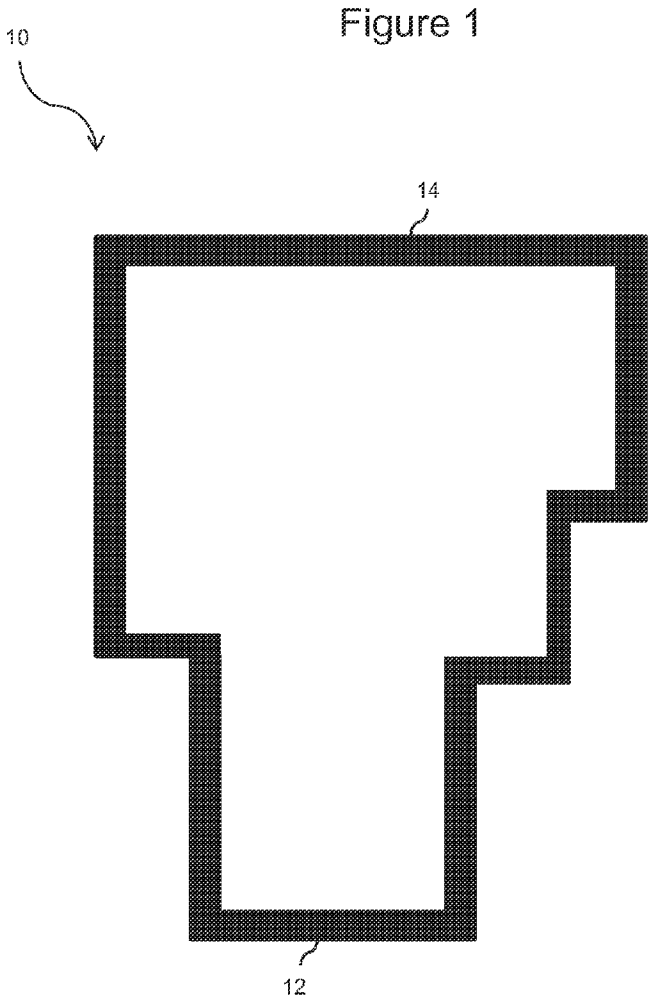
FIG. 1 illustrates a cross-section view of a metal profile without a thermal break.

The foregoing and other features will become more apparent upon reading of the following non-restrictive description of illustrative embodiments thereof, given by way of example only with reference to the accompanying drawings. Like numerals represent like features on the various drawings.

The present disclosure relates to a metal profile with a thermal break. The metal profile comprises two complementary metal structural members defining at least one junction area there between. More particularly, the junction area follows a length of the complementary metal structural members. The junction area defines a channel between the two complementary metal structural members. The metal profile also comprises a structural adhesive material filling the channel. The structural adhesive material simultaneously acts a mechanical joint and a thermal break between the two complementary metal structural members. Throughout the present description and claims, the expression structural adhesive material is used to refer to any type of adhesive material which has sufficient mechanical strength to provide a mechanical joint between the two metal structural members. Also, the expression structural adhesive refers to an adhesive having structural characteristics per se.

In a particular aspect, the junction area is located in an area of the metal profile which sustains less mechanical strength, so as to provide a wider range of structural adhesives to select from. In another particular aspect, the mechanical resistance of the selected structural adhesive is relatively low and the junction area is located in the area of the metal profile which sustains the less mechanical strength. In yet another aspect, the structural adhesive is selected so as to have a mechanical strength corresponding to the mechanical strength sustained by the junction area or greater. In another particular aspect, the structural adhesive material has both strong adhesive properties and strong insulating properties. In yet another aspect, the structural adhesive is selected to sustain a minimum mechanical strength corresponding to the mechanical strength sustained by the junction area, for a thickness of 0.03" or more. The strong adhesive properties allow the structural adhesive material to have the functionality of a mechanical joint between the two metal structural members. The strong insulating properties allow the structural adhesive material to have the functionality of a thermal break between the two metal structural members. Traditional insulating materials like polyurethane have strong insulating properties, but limited structural strength. Thus, they cannot be used instead of the structural adhesive material of the present disclosure, when the conditions of use of the metal profile impose strong constraints in terms of strength and resilience. The elongation property of the structural adhesive material provides the capacity to the shape of the metal profile to remain unaffected even in important temperature variation between the two metal structural members, thereby preventing any 'bowing' effect.

Figure 2:
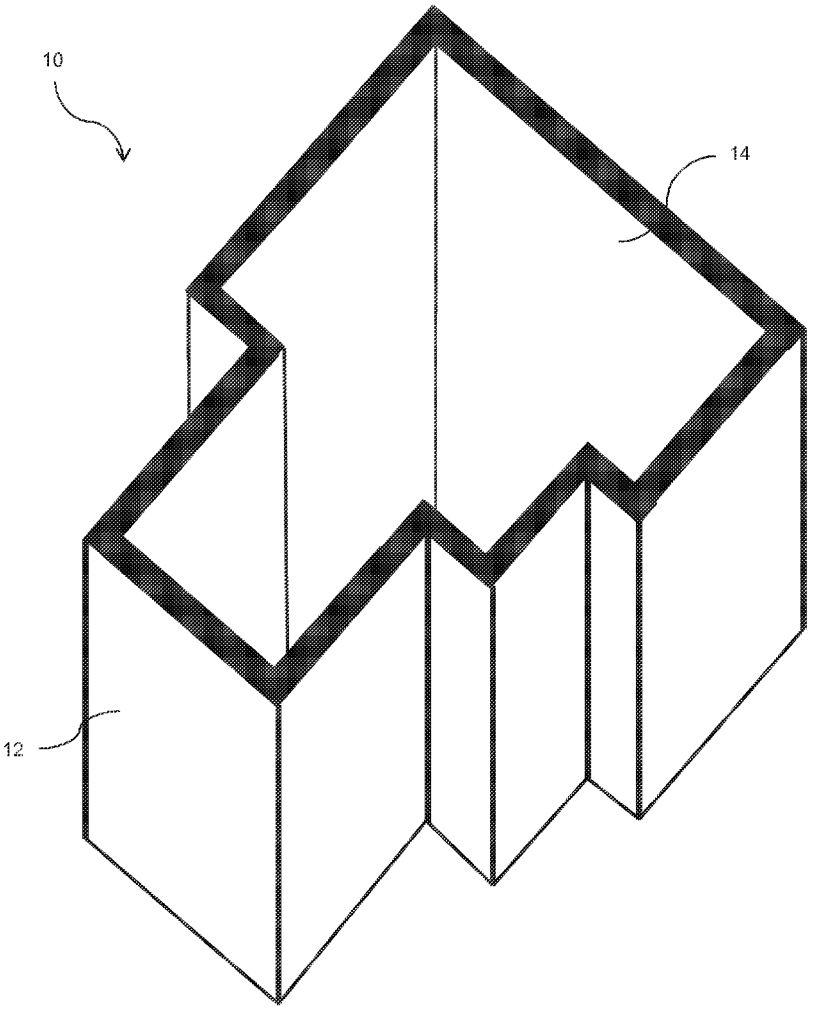
FIG. 2 illustrates a perspective view of a metal profile without a thermal break.

Reference is now made concurrently to FIGS. 1 and 2, which represent a metal profile without a thermal break. FIG. 1 is a cross-section view of the metal profile 10, and FIG. 2 is a perspective view of the metal profile 10. The metal profile consists of a single metal structural member with a first outer surface 12 and a second outer surface 14. If the first and second outer surfaces 12 and 14 are respectively in contact with two environments at significantly different temperatures, due to the high thermal conductivity of metal, a transfer of heat occurs through the metal profile 10, from the environment with the highest temperature to the environment with the lowest temperature.

Figure 3A:
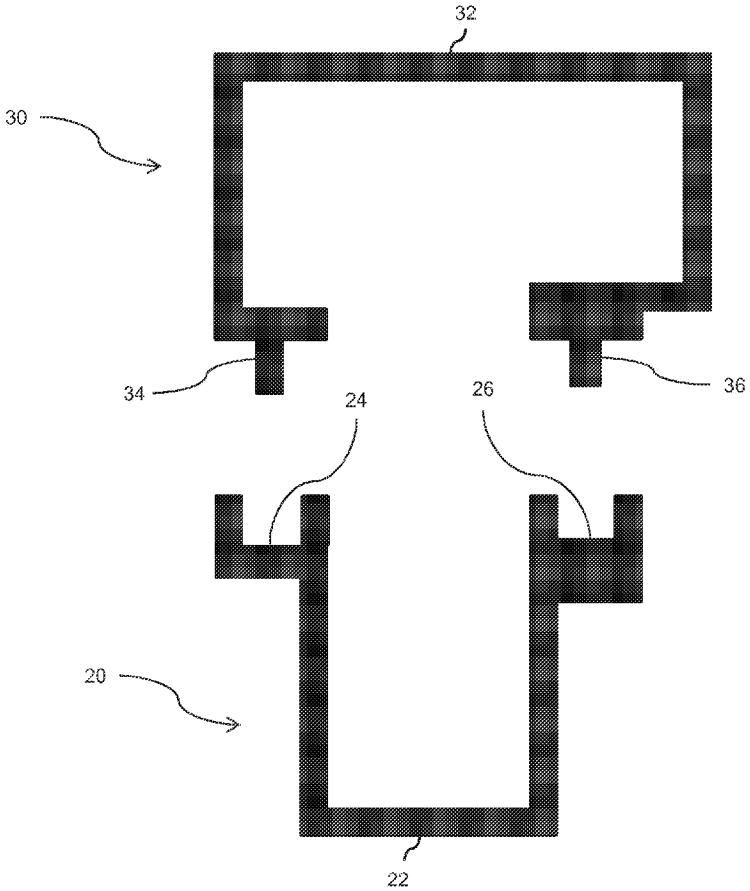
FIGS. 3A, 3B and 3C respectively illustrate a cross-section view of the present metal profile separated without a thermal break, joined without a thermal break, and joined with a thermal break, according to a non-restrictive illustrative embodiment.
Figure 3B:
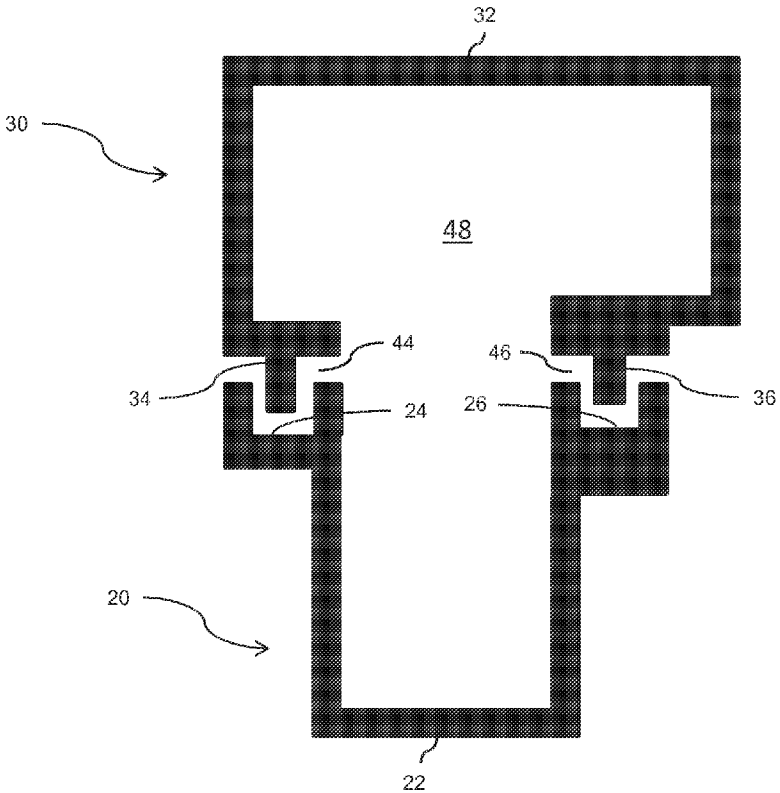
Figure 3C:
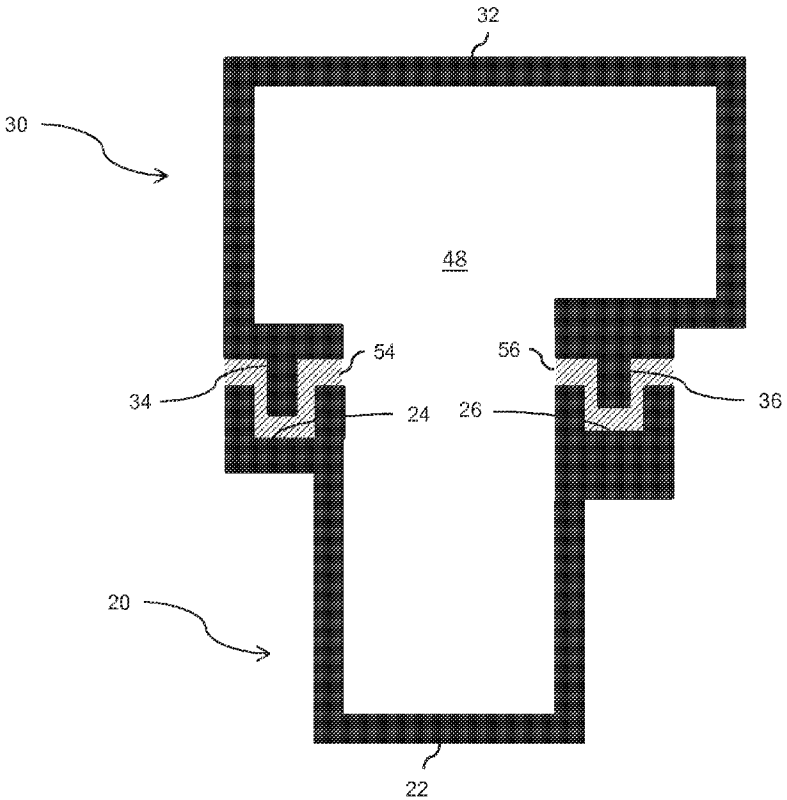
Figure 4:
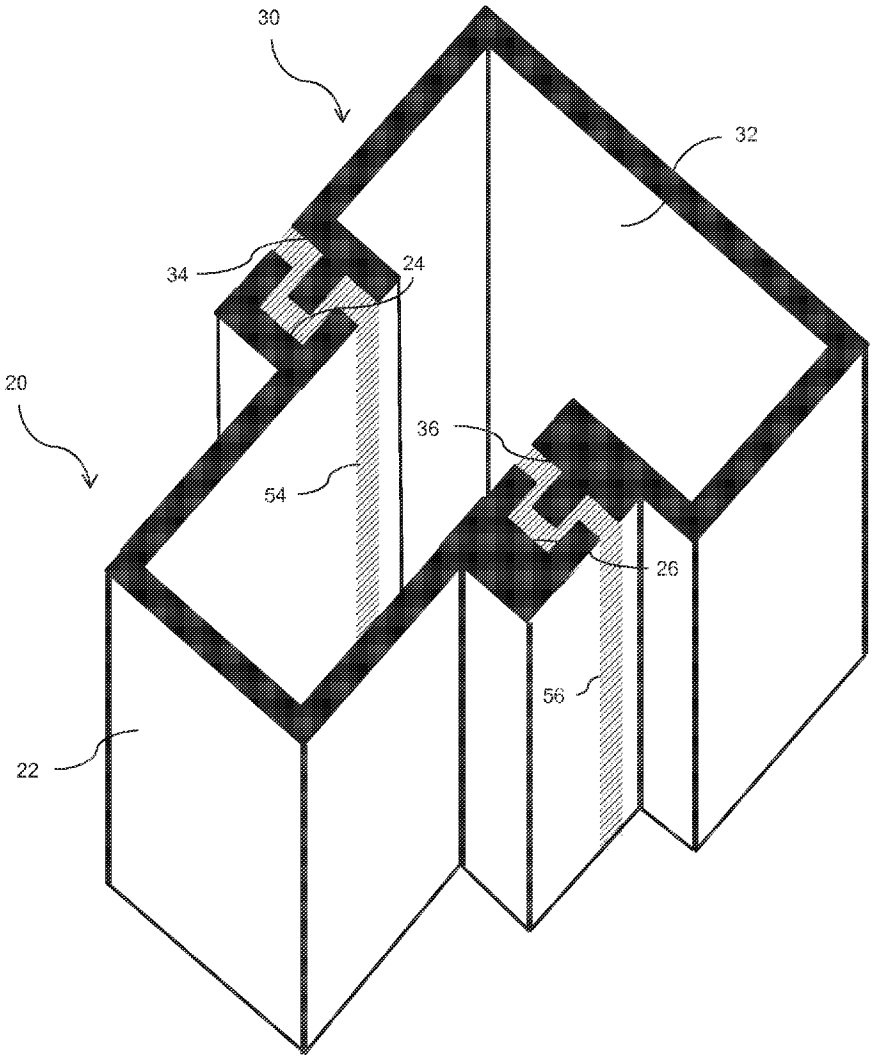
FIG. 4 illustrates a perspective view of a metal profile with a thermal break, according to a non-restrictive illustrative embodiment.

Reference is now made concurrently to FIGS. 3A, 3B, 3C and 4, which represent a metal profile with a thermal break. FIGS. 3A, 3B and 3C are a cross-section view of the present metal profile, and FIG. 4 is a perspective view of the metal profile with thermal break. The metal profile with thermal break has an exterior shape similar to the metal profile 10 of FIGS. 1 and 2, but is formed of two complementary metal structural members 20 and 30. A first outer surface 22 of the metal profile is located on the first metal structural member 20 and a second outer surface 32 of the metal profile is located on the second metal structural member 30. The two complementary metal structural members 20 and 30 define two junction areas 24 and 26. Each junction area 24 and 26 defines, when both complementary metal structural members are joined, a channel 44 and 46. Although only two channels are shown, the present metal profile is not limited to such a number of channels as will be later seen with reference to FIG. 5. The channels 44 and 46 cross the junction area, along a length of the two complementary metal structural members. For example, the channels 44 and 46 may have width of about 2 mm along the length of the junction area.

For illustration purposes, the first metal structural member 20 has two inside facing surfaces 24 and 26, having a U shape. And the second metal structural member 30 has two corresponding inside facing surfaces 34 and 36, having a T shape. As will be apparent to a person skilled in the art, the number of inside facing surfaces and their particular shapes may vary from one specific metal profile to another.

FIG. 3A is a cross-section view of the two metal structural members 20 and 30 when not assembled to constitute the metal profile. FIG. 3B is a cross-section view of the two metal structural members 20 and 30 when partially assembled to constitute the metal profile (a structural adhesive material is not present). The corresponding inside facing surfaces 24 and 34 define a first channel 44 between the two metal structural members 20 and 30. And the corresponding inside facing surfaces 26 and 36 define a second channel 46 between the two metal structural members 20 and 30. FIG. 3C is a cross-section view of the two metal structural members 20 and 30 when fully assembled to constitute the metal profile (a structural adhesive material is present). The two channels 44 and 46 have been filled with the structural adhesive material 54 and 56.

The structural adhesive material 54 and 56 forms a mechanical joint between the two metal structural members 20 and 30, by strongly adhering to their respective inside facing surfaces 24, 26, 34 and 36 across the defined channel 44 and 46, along the length of the two complementary metal structural members. The two complementary metal structural members 22 and 32 further defined, when assembled and the adhesive fills the channels 44 and 46, a cavity 48 which can be left empty so as to form an air insulation, or filled with injected polyurethane insulation. The structural adhesive material 54 and 56 filling the channels 44 and 46 forms a thermal break between the two metal structural members 20 and 30, preventing (or at least significantly limiting) a transfer of heat from outer surface 22 to outer surface 32 (or from outer surface 32 to outer surface 22 as the case may be).

In a particular embodiment, the structural adhesive material has a percentage of elongation of at least 200%. This high percentage of elongation prevents a breakage of the structural adhesive material itself, or of the adhesive link between the structural adhesive material and the metal structural members, in case of expansion or contraction of the metal structural members. For instance, an expansion or a contraction of the metal structural members may be caused by variations of temperature or by mechanical constraints, supported by the metal profile.

In another particular embodiment, the two complementary structural members of the profile are made of aluminum. Aluminum is generally used preferably to other metals for profiles where reduction of weight is sought. In a further aspect, the structural adhesive material has a thermal conductivity 450 to 550 times lower than the thermal conductivity of aluminum. In another further aspect, a rigidity of the aluminum profile (with thermal break) is similar to a rigidity of an equivalent aluminum profile (without thermal break) consisting of a single structural member made of aluminum. For example, the rigidity of the aluminum profile with the thermal break as represented in FIG. 4 is similar to the rigidity of the equivalent aluminum profile without the thermal break as represented in FIG. 2.

In still another particular embodiment, the structural adhesive material consists of a modified silane polymer. For example, the structural adhesive material consists of Loctite® 5590™. Modified silane polymers have appropriate adhesive and insulating properties to simultaneously form the mechanical joint and the thermal break between the two complementary metal structural members of the metal profile.

Experiments have been conducted with Loctite® 5590™, and the following properties have been observed: Loctite® 5590™ has a percentage of elongation of at least 200% according to technical information provided by the manufacturer, Loctite® 5590™ has a thermal conductivity 450 to 550 times lower than the thermal conductivity of aluminum according to tests performed in laboratory, and the rigidity of an aluminum profile using Loctite® 5590™ as a thermal break is similar to the rigidity of an equivalent aluminum profile consisting of a single structural member made of aluminum.

Although silane polymers and specifically Loctite® 5590™ have been mentioned as appropriate structural adhesive materials, it will be apparent to a person skilled in the art that any other structural adhesive material having appropriate properties in terms of adherence, elongation and insulation may be used as well.

In a preferred embodiment illustrated in FIG. 3C, the channels 44 and 46 defined between the metal structural members (20 and 30) have deviations for enhancing adhesion of the structural adhesive material (54 and 56). The deviations increase the surface of contact for the structural adhesive material along the channels between the two complementary metal structural members, thereby increasing the adherence there between. As mentioned previously, although U and T shapes are represented in FIG. 3C, they only constitute examples of the types of shapes which may be used for the inside facing surface areas, and other forms could be used to create different channels 44 and 46 without departing from the present invention.

Figure 5B:
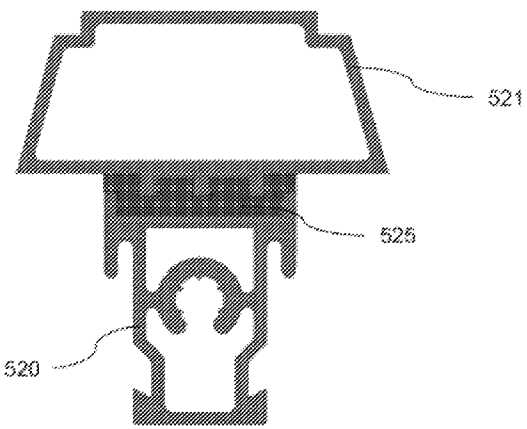
FIGS. 5A, 5B and 5C respectively illustrate a cross-section view of alternative exemplary metal profiles configurations with a thermal break, according to non-restrictive illustrative embodiments.
Figure 5A:
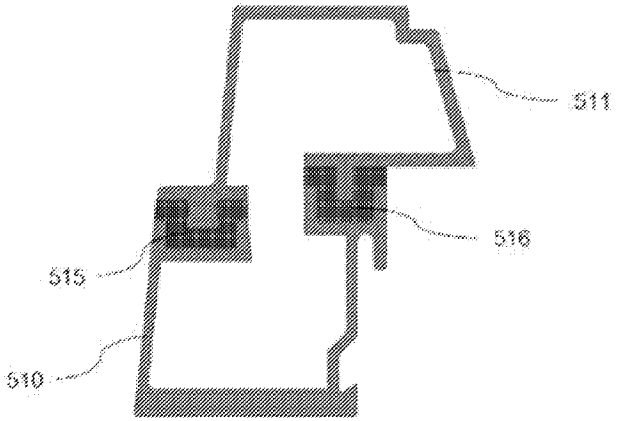
Figure 5C:
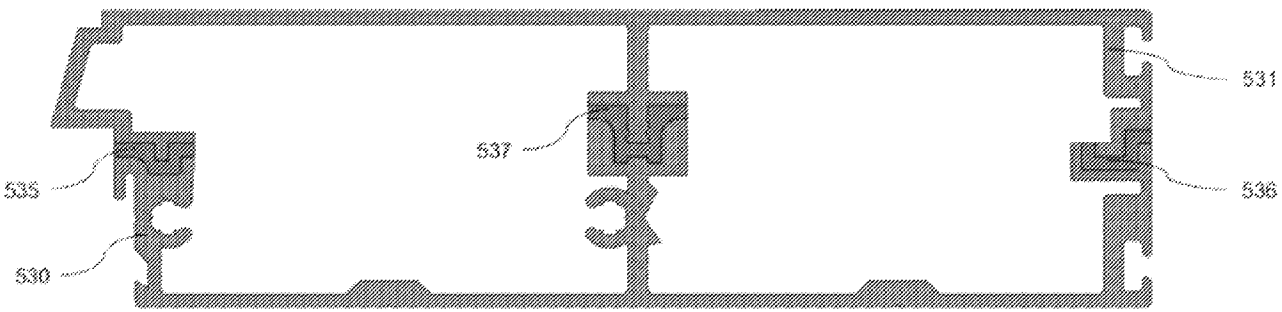

As mentioned previously, the size and shape of the metal structural members which constitute a metal profile, as well as the number and shape of the channels filled with the structural adhesive material, may vary based on the specific usage of the metal profile. FIG. 5A illustrates a cross-section view of a metal profile (similar to the one of FIG. 3C) with two metal structural members 510 and 511, and defining two channels 515 and 516 filled with the structural adhesive material. FIG. 5B illustrates a cross-section view of a metal profile with two metal structural members 520 and 521, and defining a single channel 525 filled with the structural adhesive material. FIG. 5C illustrates a cross-section view of a metal profile with two metal structural members 530 and 531, and defining three cavities 535, 536 and 537 filled with the structural adhesive material. Although FIGS. 5A-5C only depict hollow metal profiles, the present invention is not limited to such implementations. For example, the metal structural members could be solid, or filled with another material, without departing from the scope of the present invention.

Figure 6A:
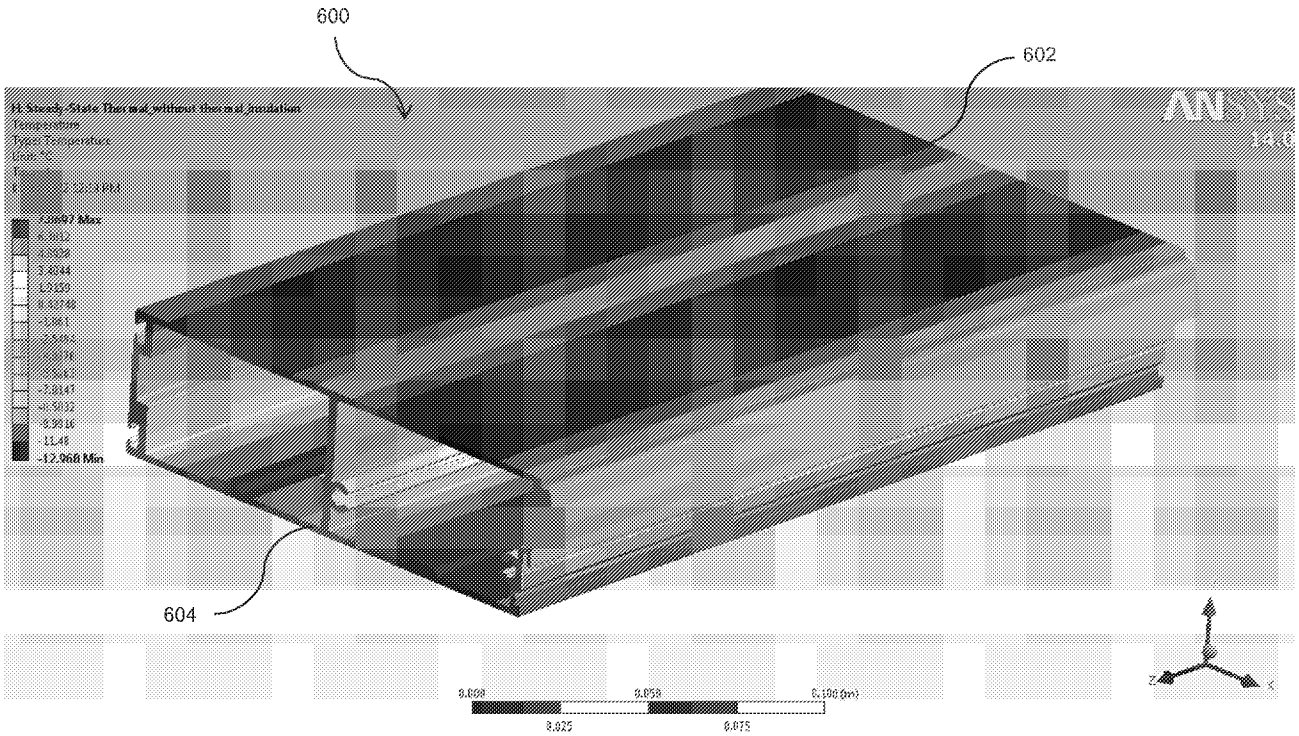
FIGS. 6A and 6B respectively illustrate thermal measurements of a front perspective view of a similar metal profile without and with thermal break, according to non-restrictive illustrative embodiments.
Figure 6B:
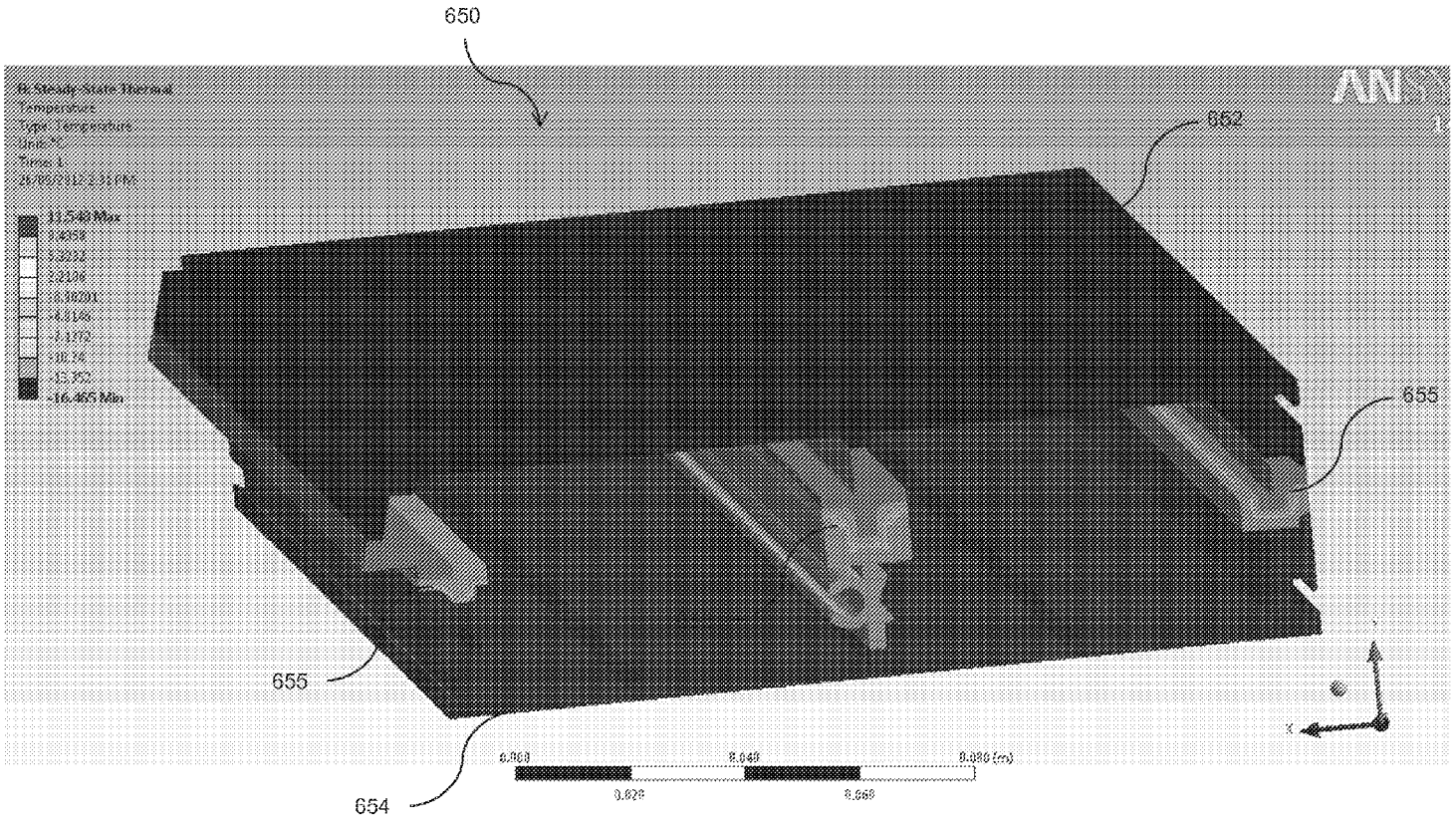

Referring now to FIGS. 6A and 6B concurrently, a front perspective view of a metal profile corresponding to the metal profile of FIG. 5C is represented with corresponding thermal measurements. The metal profile 600 in FIG. 6A comprises a single structural member and has no thermal break. A first outer surface 602 of the metal profile 600 is in contact with a colder environment, while a second outer surface 604 of the metal profile 600 is in contact with a warmer environment. The metal profile 650 in FIG. 6B comprises two structural members and defines three channels filled with a width of two millimeters of a structural adhesive material 655 (specifically Loctite® 5590™) to form a thermal break. A first outer surface 652 of the metal profile 650 is in contact with a colder environment, while a second outer surface 654 of the metal profile 650 is in contact with a warmer environment. The two metal profiles 600 and 650 are tested in similar conditions of temperature: first outer surface in contact with an environment having a temperature of approximately −20 Celsius degrees and second outer surface in contact with an environment having a temperature of approximately 15 Celsius degrees. The outer surface 602 has a temperature of approximately −13 Celsius degrees and the outer surface 604 has a temperature of approximately 7.9 Celsius degrees, unevenly distributed and with regions as low as 1.9 Celsius degrees; while the outer surface 652 has a temperature of approximately −16.5 Celsius degrees and the outer surface 654 has a consistently even temperature of approximately 11.5 Celsius degrees. This test demonstrates that the metal profile without the thermal break 600 is significantly more subject to heat transfers than the metal profile with the thermal break 650 according to the present disclosure. It shall be noted that a metal profile according to the present disclosure may be used to prevent heat transfers leading to a drop of temperature of a heated environment, as well as to prevent heat transfers leading to a rise of temperature of a cooled environment.

Although the metal profile of the present disclosure has been described in a preferred embodiment with two metal structural members defining at least one channel filled with the structural adhesive material, other configurations may be considered as well. For instance, the metal profile may comprise an assembly of more than two metal structural members, defining channels filled with the structural adhesive material; the channels being adequately positioned to form a thermal break minimizing a transfer of heat between a first outer surface of the metal profile and a second outer surface of the metal profile.

The present disclosure also relates to a door comprising an assembly of metal profiles, the metal profiles implementing any of the aforementioned embodiments of a metal profile having a thermal break, according to the present disclosure.

Figure 7:
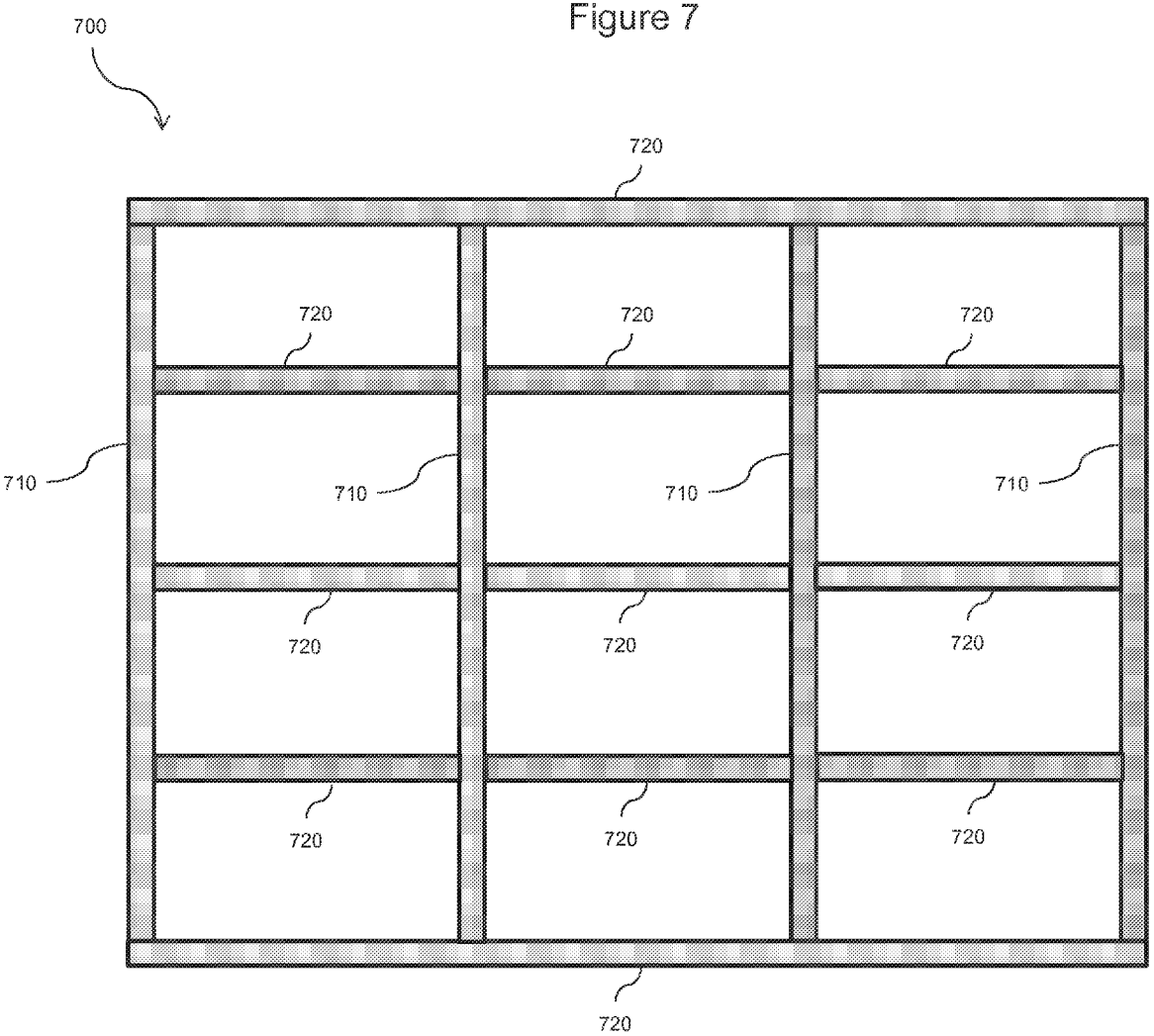
FIG. 7 illustrates a front view of a door comprising an assembly of metal profiles with a thermal break, according to a non-restrictive illustrative embodiment.

FIG. 7 illustrates a front view of such a door comprising an assembly of metal profiles with a thermal break. The door consists of a metallic frame 700, made of an assembly of vertical 710 and horizontal 720 metal profiles. For instance, the metal profiles may be the one represented in FIG. 6B. The metallic frame 700 supports an additional material (not represented in FIG. 7), for example glass or plastic. The metal profiles are assembled in such a manner that their first outer surfaces correspond to an inner surface of the door, and their second outer surfaces correspond to an outer surface of the door. Thus, the thermal break formed by the structural adhesive material of the metals profiles between their first outer surfaces and their second outer surfaces generally forms a thermal break between the inner surface and the outer surface of the door.

In a particular embodiment, the structural members of the profiles assembled to make the door are made of aluminum. And because of the adhesive properties of the structural adhesive material (by contrast to for example using a polyurethane foam), a rigidity of the profiles (with the thermal break) is similar to a rigidity of equivalent profiles (without thermal break) consisting of a single structural member made of aluminum. Thus, the rigidity of the aluminum profiles with the thermal break allows the manufacture of a door (with a thermal break) having a very large width of up to 24 feet; and having very heavy double or triple sealed units.

Although the present disclosure has been described hereinabove by way of non-restrictive, illustrative embodiments thereof, these embodiments may be modified at will within the scope of the appended claims without departing from the spirit and nature of the present disclosure.

What is claimed is:

1. A metal profile comprising:

two complementary metal structural members, one of the two complementary metal structural members defining a longitudinal groove, an other of the two complementary metal structural members defining a longitudinal protrusion, insertion of the longitudinal protrusion into the longitudinal groove defining a U-shaped channel between the two complementary metal structural members; and a structural adhesive material filling the U-shaped channel, the structural adhesive material simultaneously acting as a mechanical joint and a thermal break between the two complementary metal structural members.

2. The metal profile of claim 1, wherein the two complementary structural members are made of aluminum.

3. The metal profile of claim 2, wherein the structural adhesive material has a thermal conductivity 450 to 550 times lower than the thermal conductivity of aluminum.

4. The metal profile of claim 1, wherein the shape of the channel and a selection of the structural adhesive material confer rigidity to the metal profile.

5. The metal profile of claim 4, wherein the structural adhesive material consists of a modified silane polymer.

6. The metal profile of claim 1, wherein the structural adhesive material has is capable of extending by at least 200% from its original length when under tension.

7. The metal profile of claim 6, wherein the structural adhesive material consists of a modified silane polymer.

8. The metal profile of claim 1, wherein the shape of the channel provides enhanced adhesion of the structural adhesive material to the two complementary metal structural members.

9. The metal profile of claim 1, wherein one of the two complementary metal structural members is in a first environment, an other one of the two complementary metal structural members is in a second environment, the thermal break minimizing a transfer of heat between the second environment and the first environment through the metal profile.

10. The metal profile of claim 1 wherein the two complementary metal structural members define two U-shaped channels, and the two complementary metal structural members further define a cavity to be filled by the structural adhesive material between the U-shaped channels.

11. The metal profile of claim 1 wherein the two complementary metal structural members define three U-shaped channels, and the two complementary metal structural members further define two cavities to be filled by the structural adhesive material between the U-shaped channels.

12. The metal profile of claim 1, wherein a first of the two complementary metal structural members has a first substantially flat outer surface, a second of the two complementary metal structural members has a second substantially flat outer surface substantially parallel to the first substantially flat outer surface, two or more U-shaped channels being defined between the two substantially flat outer surfaces.

13. A door comprising an assembly of metal profiles according to claim 1.

14. The door of claim 13, wherein the two complementary structural members of the metal profiles are made of aluminum.

15. The door of claim 13, wherein the structural adhesive material has a thermal conductivity 450 to 550 times lower than the thermal conductivity of aluminum.

16. The door of claim 13, wherein the shape of the channel and a selection of the structural adhesive material confer rigidity to the metal profile.

17. The door of claim 13, wherein the door has a width of up to 24 feet.

18. The door of claim 13, wherein the structural adhesive material consists of a modified silane polymer.

19. The door of claim 13, wherein the structural adhesive material has is capable of extending by at least 200% from its original length when under tension.

20. The door of claim 13, wherein the structural adhesive material consists of a modified silane polymer.

* * * * *